US011812863B1

(12) United States Patent
Osler

(10) Patent No.: US 11,812,863 B1
(45) Date of Patent: Nov. 14, 2023

(54) ACTIVE SITTING CHAIR

(71) Applicant: Kinetic Furniture of Vermont Inc., Colchester, VT (US)

(72) Inventor: Turner Osler, Colchester, VT (US)

(73) Assignee: Kinetic Furniture of Vermont, Inc., Colchester, VT (US)

( * ) Notice: Subject to any disclaimer, the term of this patent is extended or adjusted under 35 U.S.C. 154(b) by 3 days.

(21) Appl. No.: 17/806,866

(22) Filed: Jun. 14, 2022

(51) Int. Cl.

| | |
|---|---|
| ***A47C 3/029*** | (2006.01) |
| ***A47C 9/00*** | (2006.01) |
| ***A47D 13/10*** | (2006.01) |
| ***A63B 26/00*** | (2006.01) |
| ***A47C 3/12*** | (2006.01) |
| ***A47C 7/02*** | (2006.01) |
| ***A63B 22/14*** | (2006.01) |
| ***A63G 23/00*** | (2006.01) |
| ***A63B 22/16*** | (2006.01) |
| *A47C 5/12* | (2006.01) |

(52) U.S. Cl.
CPC ..... *A47C 3/029* (2013.01); *A47C 3/12* (2013.01); *A47C 7/029* (2018.08); *A47C 9/002* (2013.01); *A47D 13/102* (2013.01); *A63B 22/14* (2013.01); *A63B 22/16* (2013.01); *A63B 26/003* (2013.01); *A63G 23/00* (2013.01); *A47C 5/12* (2013.01); *A63B 2208/0233* (2013.01)

(58) Field of Classification Search
CPC ..... A47C 3/029; A47C 3/12; A47C 7/029; A47C 9/002; A47C 5/12; A47D 13/102; A63B 22/14; A63B 22/16; A63B 26/003; A63B 2208/0233; A63G 23/00
USPC ..... 297/195.1, 195.11, 215.6, 258.1, 270.1, 297/270.5, DIG. 2, DIG. 3
See application file for complete search history.

(56) References Cited

U.S. PATENT DOCUMENTS

| | | | | |
|---|---|---|---|---|
| 3,770,319 | A * | 11/1973 | Ono | A47C 9/002 297/461 |
| 4,037,833 | A * | 7/1977 | Anderson | A63G 23/00 280/1.13 |
| 4,141,588 | A * | 2/1979 | Anderson | A47C 3/029 472/102 |
| 4,696,467 | A | 9/1987 | Markow | |
| 5,294,187 | A * | 3/1994 | Racicot | B60B 5/02 301/1 |
| 5,785,633 | A | 7/1998 | Stroppiana | |
| D591,064 | S * | 4/2009 | Lee | D6/334 |

(Continued)

FOREIGN PATENT DOCUMENTS

| | | | | |
|---|---|---|---|---|
| JP | 2015077192 | A * | 4/2015 | A47C 4/54 |
| WO | 2014038958 | A1 | 3/2014 | |

*Primary Examiner* — Robert Canfield
(74) *Attorney, Agent, or Firm* — Downs Rachlin Martin PLLC

(57) ABSTRACT

An active sitting chair is provided that encourages a sitter/user to sit actively by requiring balance adjustments and core engagement. The active sitting chair can be efficiently produced while being relatively sturdy and lightweight. The main body may be a monocoque shell that includes a rounded lower portion that contacts the surface the chair is on and promotes wobble of the chair when a sitter is seated on the chair. The chair may also include built-in handles for ease of lifting and a seat portion at the top of the chair that may include a cushion or similar component for increasing the stability and/or comfort of a sitter.

18 Claims, 10 Drawing Sheets

(56) References Cited

U.S. PATENT DOCUMENTS

| | | | | |
|---|---|---|---|---|
| 7,901,012 | B1 * | 3/2011 | Perdue | B60B 3/02 D12/208 |
| D659,204 | S * | 5/2012 | Cotter | A63B 43/04 D21/680 |
| 8,998,319 | B2 * | 4/2015 | Bahneman | A47C 9/00 297/214 |
| D756,139 | S * | 5/2016 | Chadwick | D6/352 |
| 10,010,470 | B2 * | 7/2018 | Bradford | A63B 23/1281 |
| 11,045,005 | B2 * | 6/2021 | Harguth | A47C 3/04 |
| 2013/0274080 | A1 * | 10/2013 | Matsushita | A47C 7/029 482/142 |
| 2015/0133279 | A1 * | 5/2015 | Alessandri | A47C 9/002 482/142 |
| 2017/0311726 | A1 * | 11/2017 | Danielson | A47C 7/72 |
| 2020/0046131 | A1 * | 2/2020 | Limingoja | A47C 9/02 |

* cited by examiner

ACTIVE SITTING CHAIR

FIELD OF THE INVENTION

The present invention relates to seating devices. In particular, the present invention provides an ergonomic seat for promoting active sitting.

BACKGROUND

Human bodies are built to move and generally require constant activity to remain supple and healthy. Unfortunately, modern life involves a good deal of sitting; indeed, many professions require many hours of simply sitting, which is an unnatural demand on the human bodies-so unnatural that children instinctively rebel against it.

Sitting, and especially sitting still, aligns human bodies oddly, and denies joints the constant small adjustments that help to circulate the joint fluid which helps nourish the delicate cartilage lining of the joints. Additionally, sitting still denies core muscles the exercise involved in aligning and realigning our spines, exercise vital to keeping our core musculature strong and responsive. Moreover, extended and repetitive sitting has been linked to other health maladies. Indeed, the mismatch between our 21st-century-built environment and our hunter-gatherer-optimized bodies has led to a variety of serious health problems: obesity, diabetes, heart disease, and even cancer, a litany of acquired diseases that can culminate in early death. These effects are not subtle with a 50% increase in cancer risk among those who sat the most. Perhaps more importantly, simply reducing sitting could increase our lifespans by as much as two years.

One potential solution to these health issues may be the use of active chairs, which are designed to cause users to sit actively and thus may allow for the recapture of the healthy blood chemistry of our hunter-gatherer forebears. These chairs allow for movement while sitting, and so allow us to sit all day as our modern lives require without suffering the harm brought on by sitting inertly. An example of one such an active chair is described in commonly owned U.S. Pat. No. 10,010,758. However, no single active chair is appropriate for all individuals or all situations, thus there is a need for active chairs provide for other types of motion and/or are appropriate for different users/situations.

SUMMARY OF THE DISCLOSURE

An active sitting chair includes a monocoque shell having a bottom, a top, a front member, a back member, a first side member, and a second side member opposite the first side member, wherein the front member connects and curves outwardly between the bottom and the top, wherein the back member connects and curves outwardly between the bottom and the top, wherein the first side member connects the bottom and the top, is connected to the front member and the back member, and curves inwardly between the bottom and the top, and wherein the second side member connects the bottom and the top, is connected to the front member and the back member, and curves inwardly between the bottom and the top. A seat area is included on the top and a rounded lower portion attached to the bottom and arranged to rest on a supporting surface.

Another aspect of the invention provides an active sitting chair having a hollow, uninterrupted monocoque shell that includes a ring-shaped outer portion forming a continuous surface having a bottom portion, a top portion, a front portion, a rear portion, a first side edge, and a second side edge opposite the first side edge, a first side portion connected to the first side edge, wherein the first side portion curves inwardly from the first side edge, and a second side portion connected to the second side edge, wherein the second side portion curves inwardly from the second side edge. A rounded lower portion is attached to the bottom portion and arranged to rest on a supporting surface.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
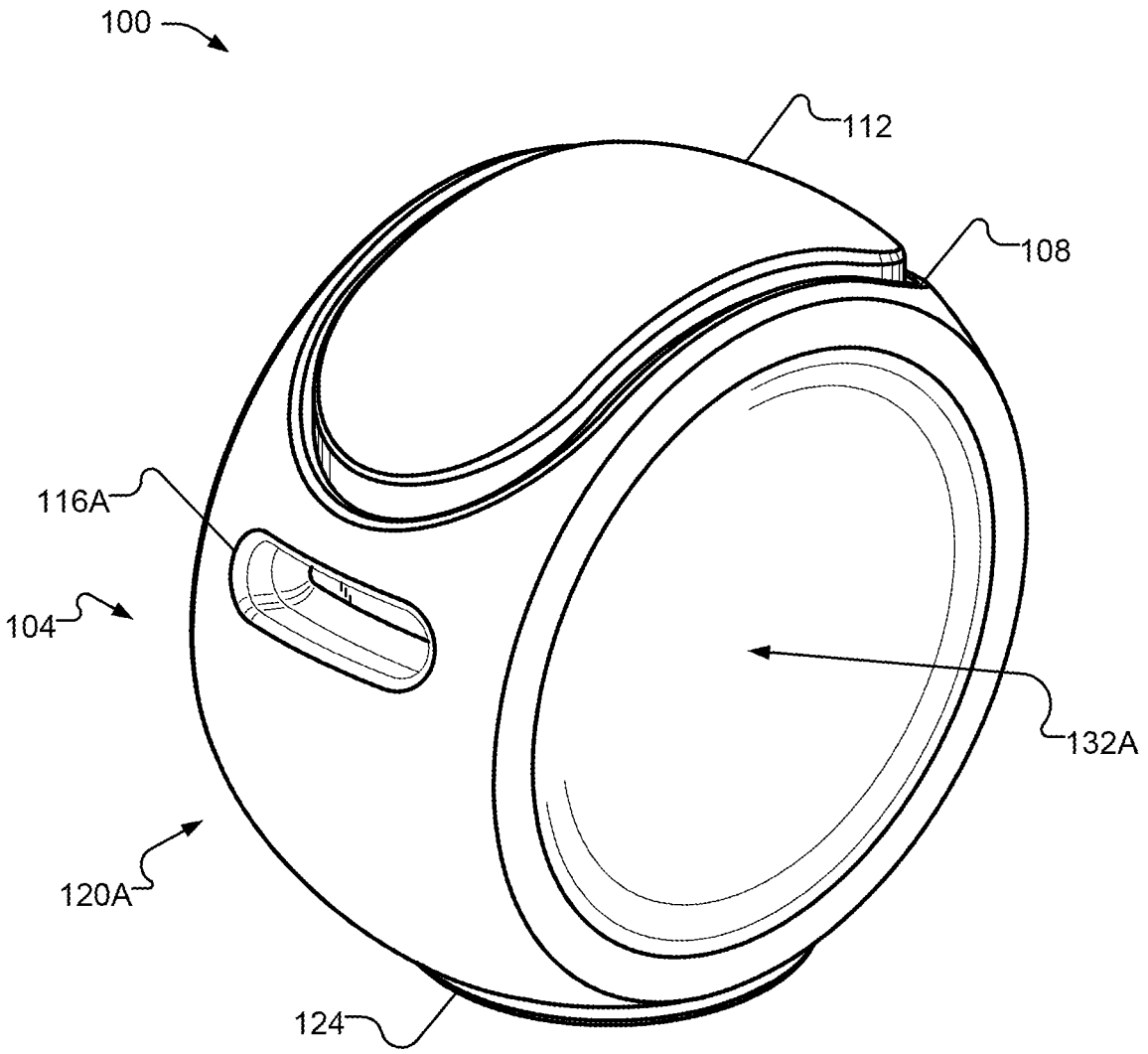
FIG. 1 is a perspective view of an active sitting chair in accordance with an embodiment of the present invention.

An active sitting chair is provided that encourages a sitter/user to sit actively by requiring balance adjustments and core engagement while sitting on the chair. The chair can be efficiently produced while being relatively sturdy and lightweight. The main body may be a monocoque shell that includes a rounded lower portion that contacts a supporting surface the chair is on and promotes wobbling of the chair when in use. The chair may also include built-in handles for ease of lifting/relocating and a seat portion at the top of the chair that may include a cushion or similar component for increasing the stability and/or comfort of a sitter.

A ring or other similar structure may be included above the rounded lower portion to limit the extent of wobble to prevent the chair from tipping over. The monocoque structure provides structural integrity to support the weight of sitters while also allowing the chair to be hollow, which allows for the chair to be made efficiently and be relatively lightweight. Further, in a preferred embodiment, the front and rear portions connecting the rounded lower portion to the seat portion are convex and the side portions are concave. The concave shapes of the side portions provide additional structural integrity for supporting the weight of a sitter since the arch-like profile created is less likely to buckle. In another preferred embodiment, the profile of the chair when viewed from the front or back tapers such that the chair is narrower toward the top.

Turning to the figures, an embodiment is shown in FIGS. 1-6 of an active sitting chair 100 that includes a hollow, single outer monocoque shell 104, a seat portion 108, a cushion 112 on seat portion 108, a front portion 120A, a back portion 120B, a ring 124, a rounded lower portion 128, a first side portion 132A, and a second side portion 132B. A first indentation 116A that is sized and configured to serve as a handle may be included on front portion 120A and a second indentation 116B that is sized and configured to serve as a handle may be included on back portion 120B. Chair 100 is preferably hollow, with the design and shape of monocoque shell 104 providing the structural integrity necessary to support a sitter.

Figure 2:
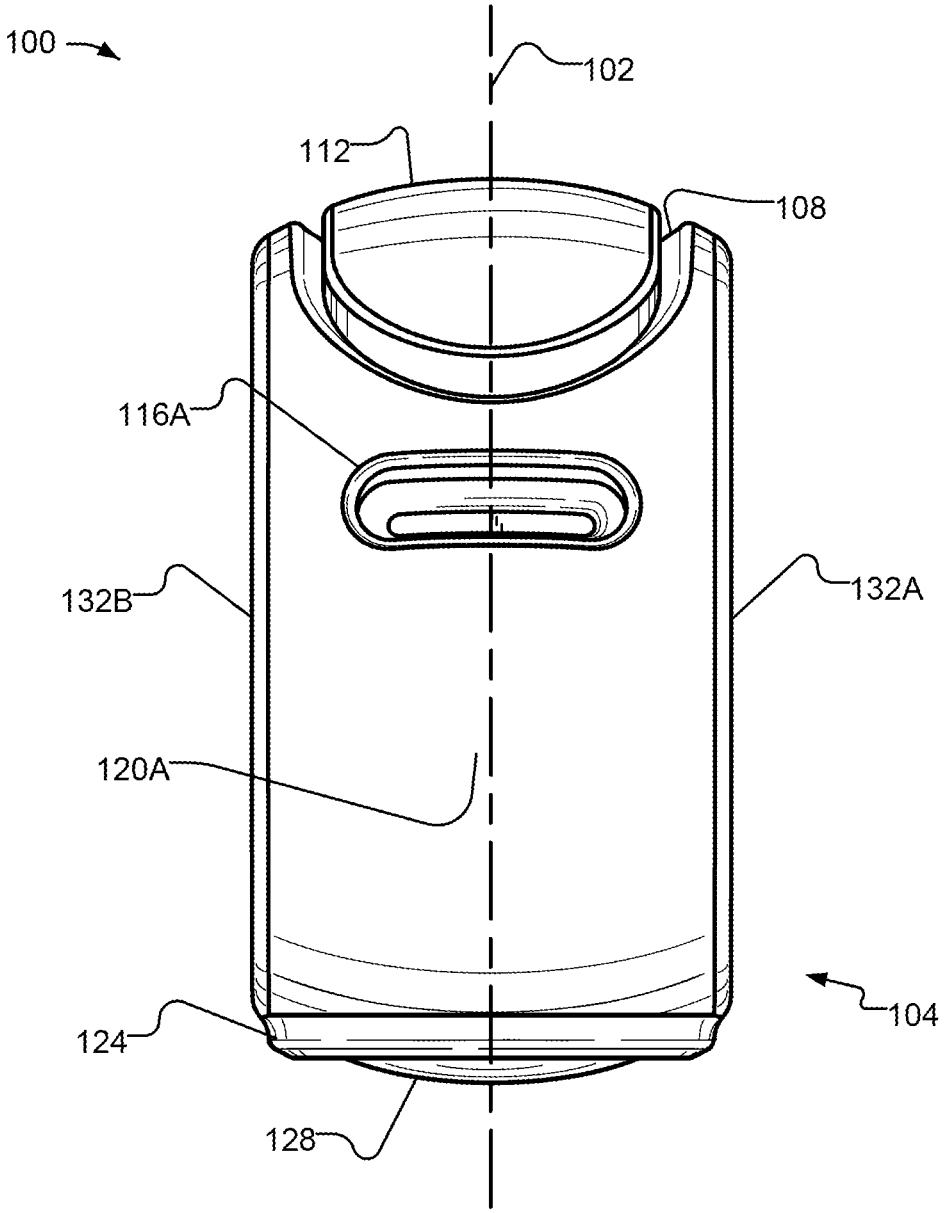
FIG. 2 is a front view of the chair of FIG. 1.
Figure 3:
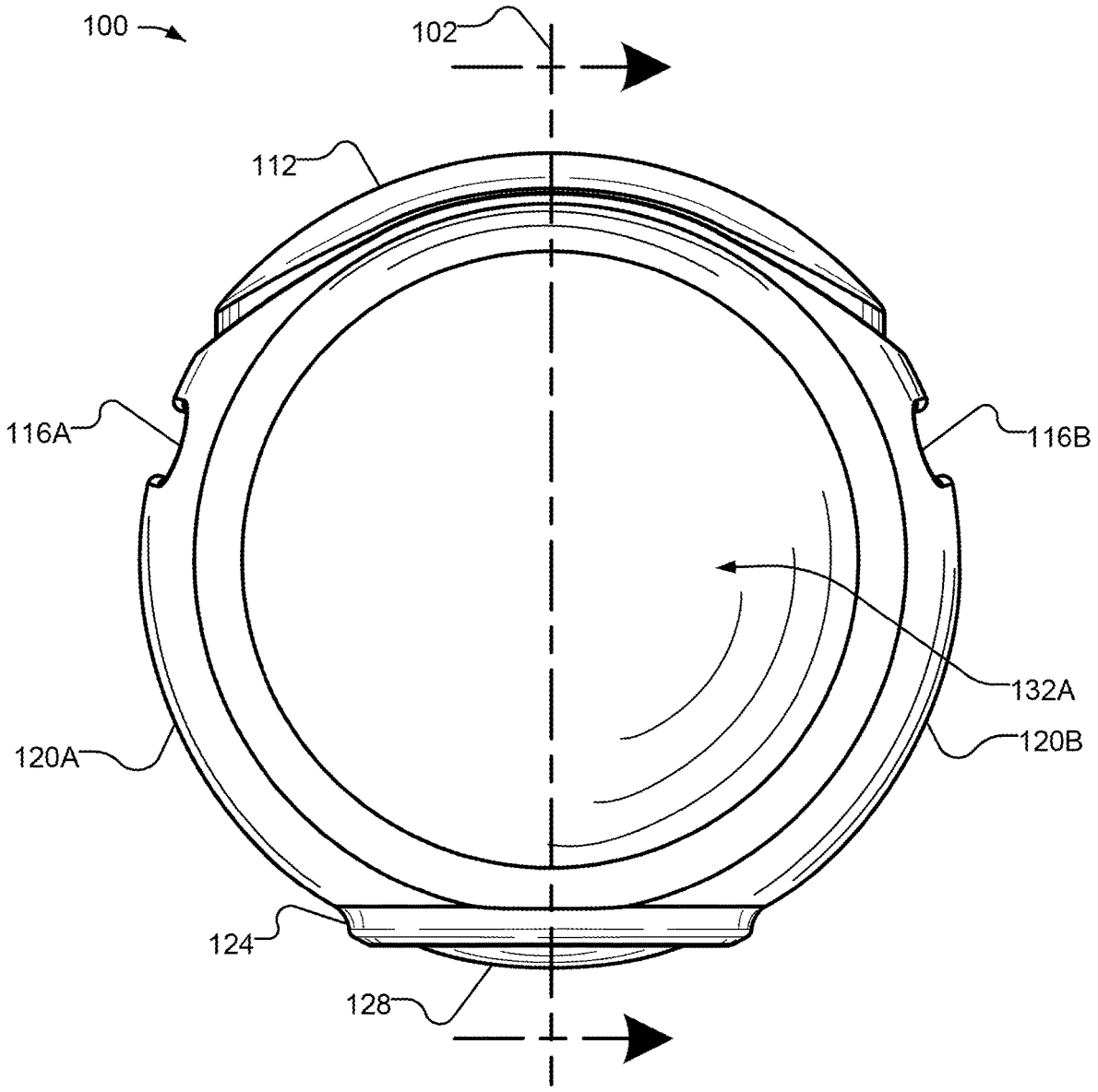
FIG. 3 is a side view of the chair of FIG. 1.
Figure 6:
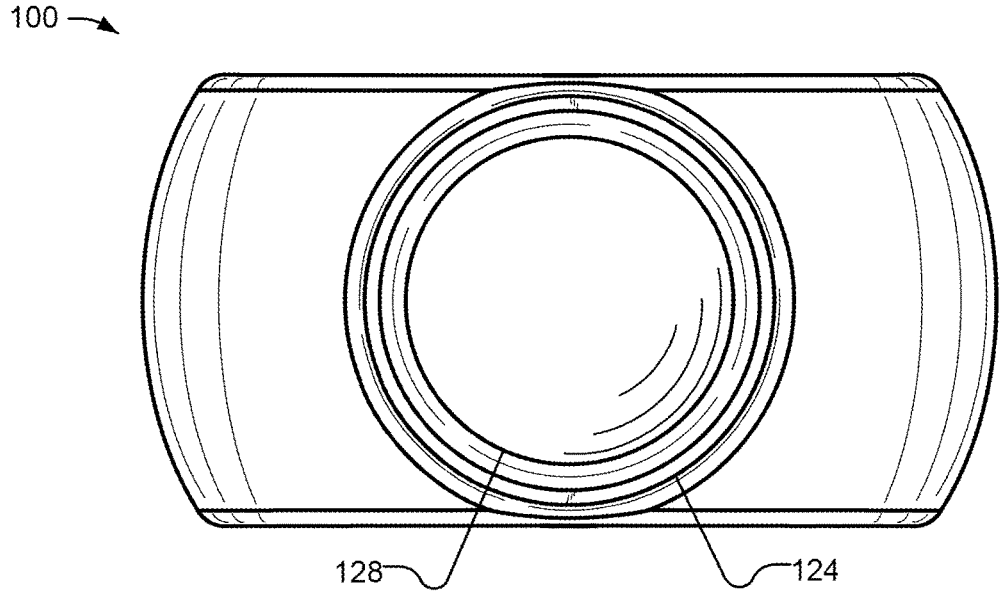
FIG. 6 is a bottom of the chair of FIG. 1.
Figure 7:
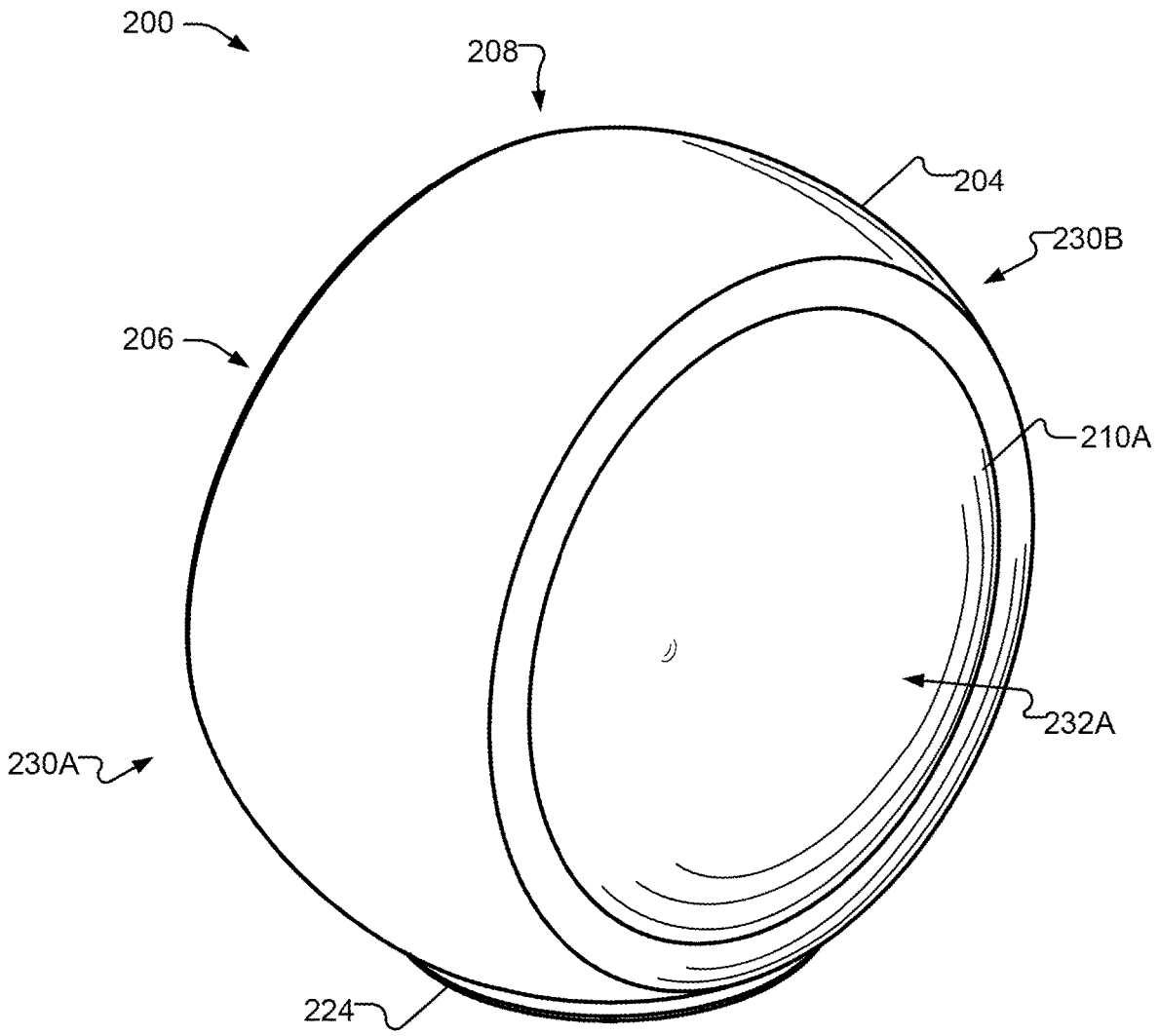
FIG. 7 is a perspective view of an active sitting chair in accordance with another embodiment of the present invention.

Rounded lower portion 128 (as best seen in FIGS. 2, 3, and 6) rests on a supporting surface, such as a floor, when chair 100 is in use and is shaped and configured to promote wobbling motion when a sitter is sitting on chair 100. Ring 124 (as can be seen in FIGS. 2-3) is positioned above rounded lower portion 128 in order to limit the range of tilt otherwise allowed by rounded lower portion 128 to avoid chair 100 tipping over. Each of front portion 120A and back portion 120B extends from rounded lower portion 128 up to seat portion 108 and are preferably convex, as can be seen in FIG. 3, in that they curve away from the center of chair 100 at the middle before curving back toward seat portion 108.

Figure 4:
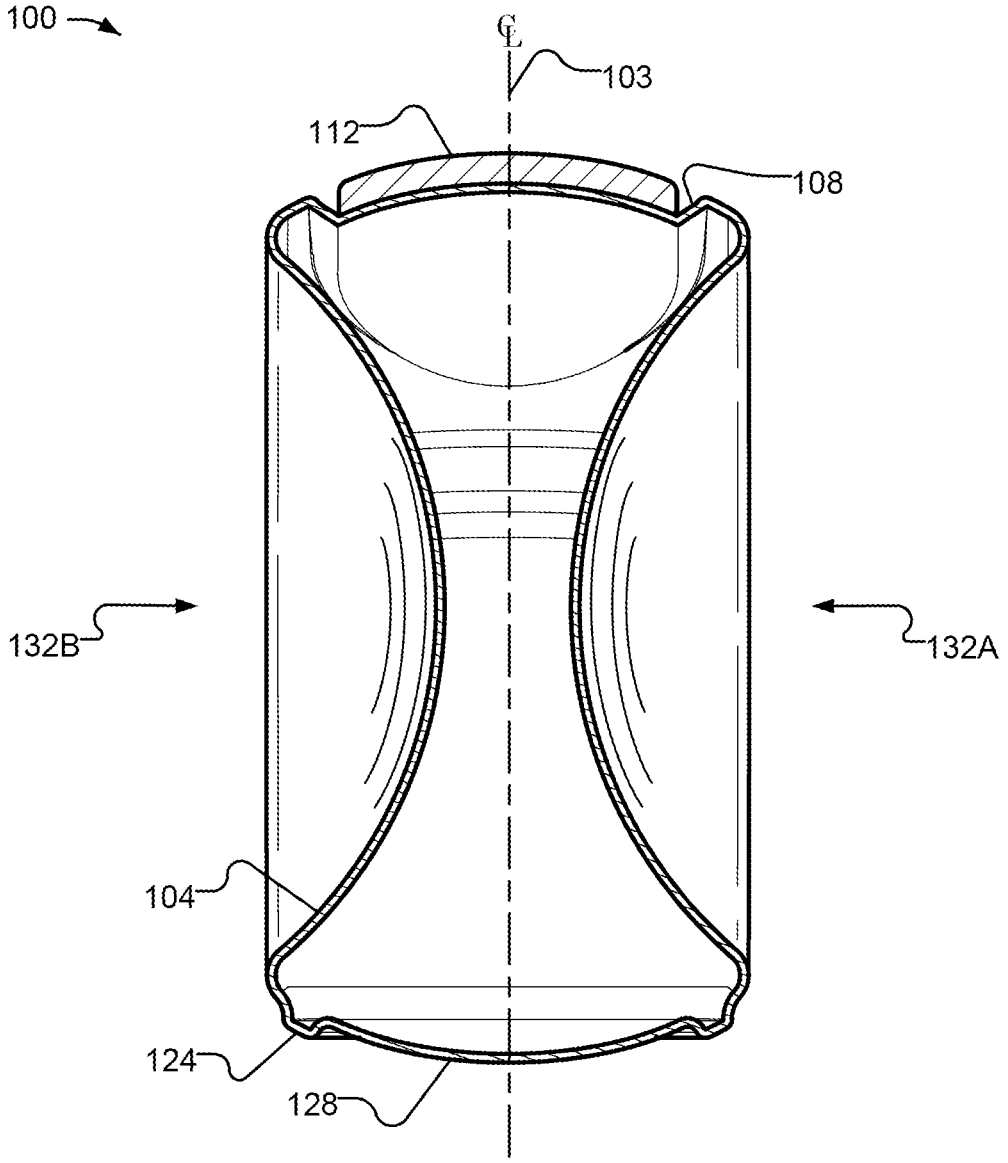
FIG. 4 is a cross section view of the chair of FIG. 3.
Figure 5:
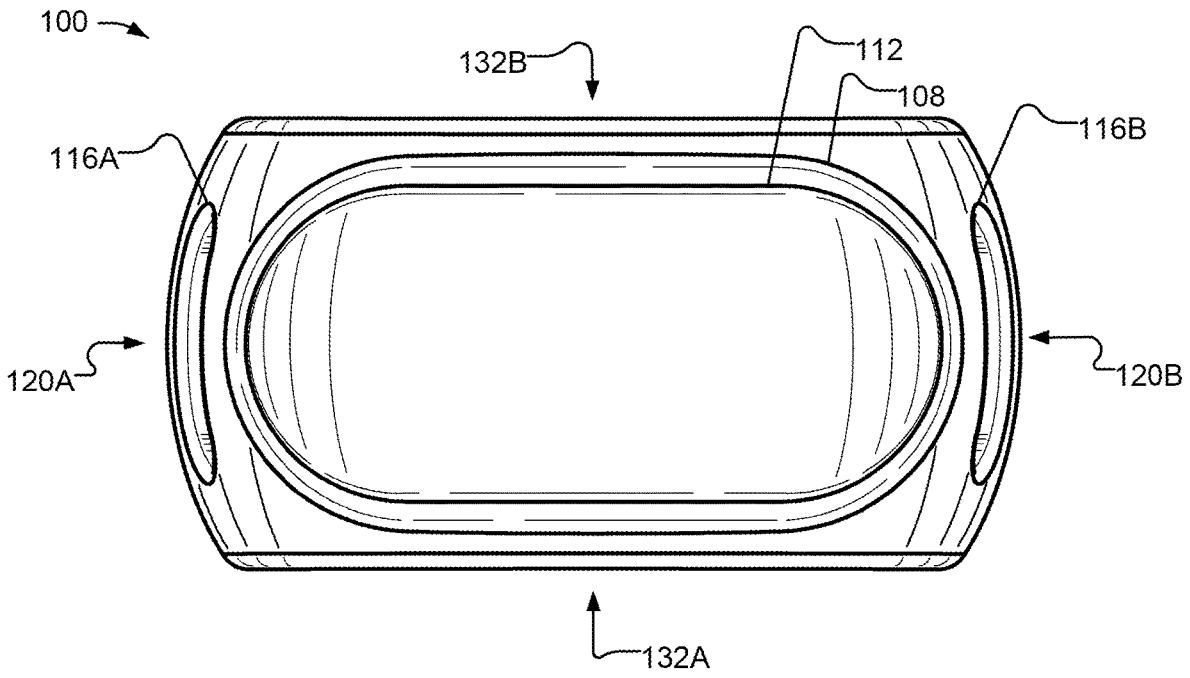
FIG. 5 is a top view of the chair of FIG. 1.

Preferably, and as shown in FIG. 4, first side portion 132A and second side portion 132B are concave with respect to a vertical axis 102 of chair 100, bending inward between connections at a lower part with rounded lower portion 128 and at an upper part with seat portion 108. The concave profiles of first side portion 132A and second side portion 132B are less likely to buckle than straight sides and allow chair 100 to be hollow and shell 104 to be relatively thin while still supporting a sitter. The inward curving portions of the side members may be such that in a preferred embodiment a portion of each of the side members extends more than halfway to a vertical centerline 103 of the shell at least at the most extended portion as shown in FIG. 4. Shell 104 may be made of any suitable material, such as acrylonitrile butadiene styrene, and for use as an active chair may have a thickness of from about 0.32 cm to 1.27 cm, and preferably about 0.64 cm.

In another embodiment, as shown for example in FIGS. 7-12, an active sitting chair 200 includes a hollow, single outer monocoque shell 204; including a ring-shaped portion 206 having a seat area 208, a front portion 230A, and a back portion 230B, a ring 224, a rounded lower portion 228, a first side portion 232A, and a second side portion 232B. Ring shaped portion 206 includes a rim or edge 206 on each side (e.g., 210A, 210B) to which first side portion 232A and second side portion 232B are respectively connected. Chair 200 is preferably hollow, with the design and shape of monocoque shell 204 providing the structural integrity necessary to support a sitter.

Figure 8:
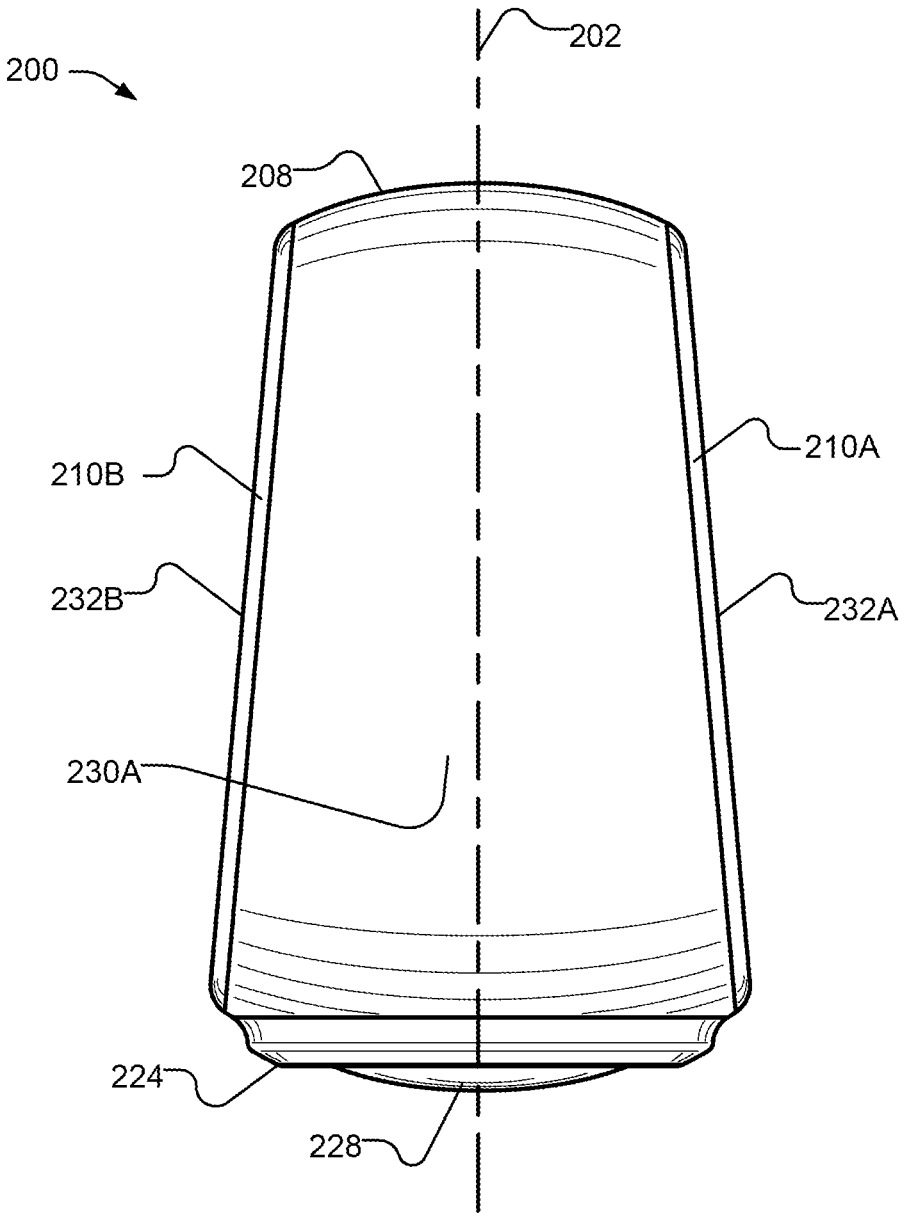
FIG. 8 is a front view of the chair of FIG. 7.
Figure 9:
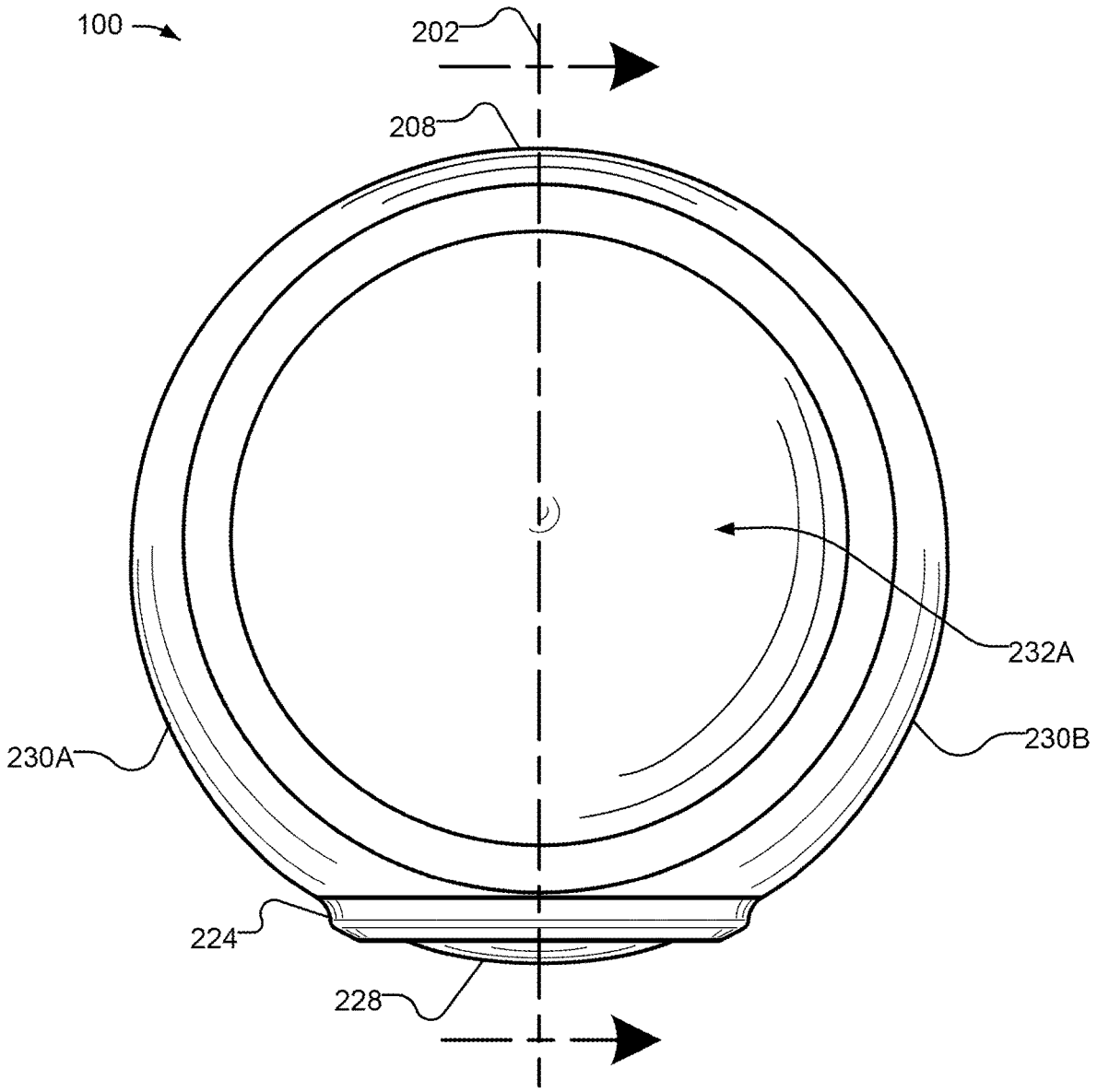
FIG. 9 is a side view of the chair of FIG. 7.
Figure 12:
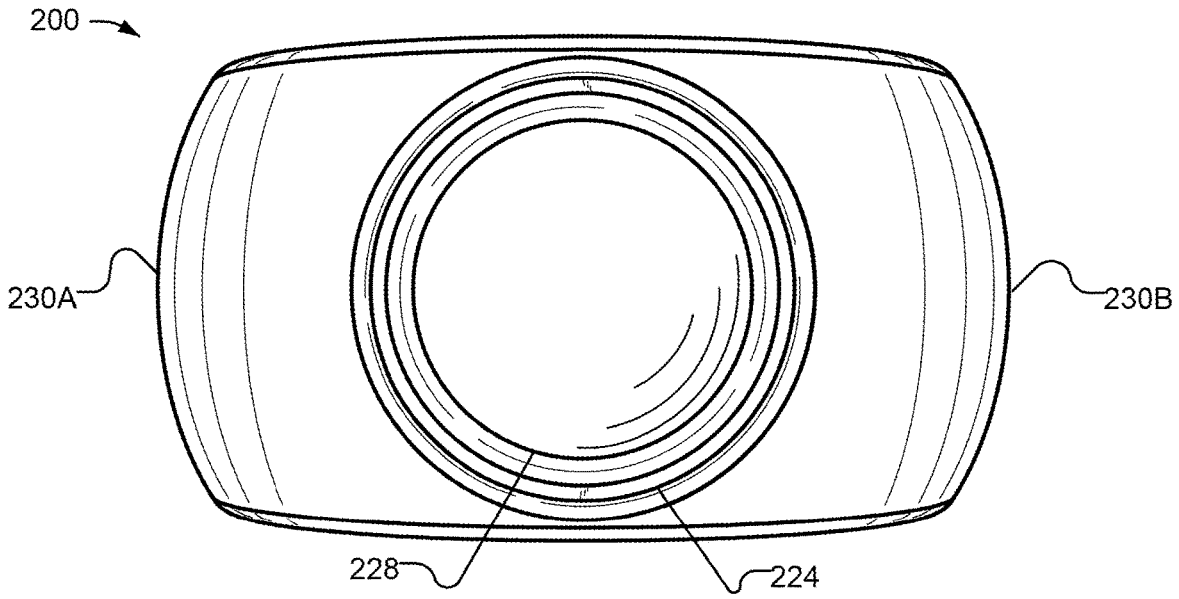
FIG. 12 is a bottom of the chair of FIG. 7.

Rounded lower portion 228 (as best seen in FIGS. 8, 9, and 12) rests on a supporting surface, such as a floor, when chair 200 is in use and is shaped and configured to promote wobbling motion when a sitter is sitting on chair 200. Ring 224 (as can be seen in FIGS. 8-9) is positioned above rounded lower portion 228 in order to limit the range of tilt otherwise allowed by rounded lower portion 228 to avoid chair 200 tipping over. Each of front portion 230A and back portion 230B extends from rounded lower portion 228 up to seat portion 208 and are preferably convex, as can be seen in FIG. 9, in that they curve away from the center of chair 200 at the middle before curving back toward seat portion 208.

Figure 10:
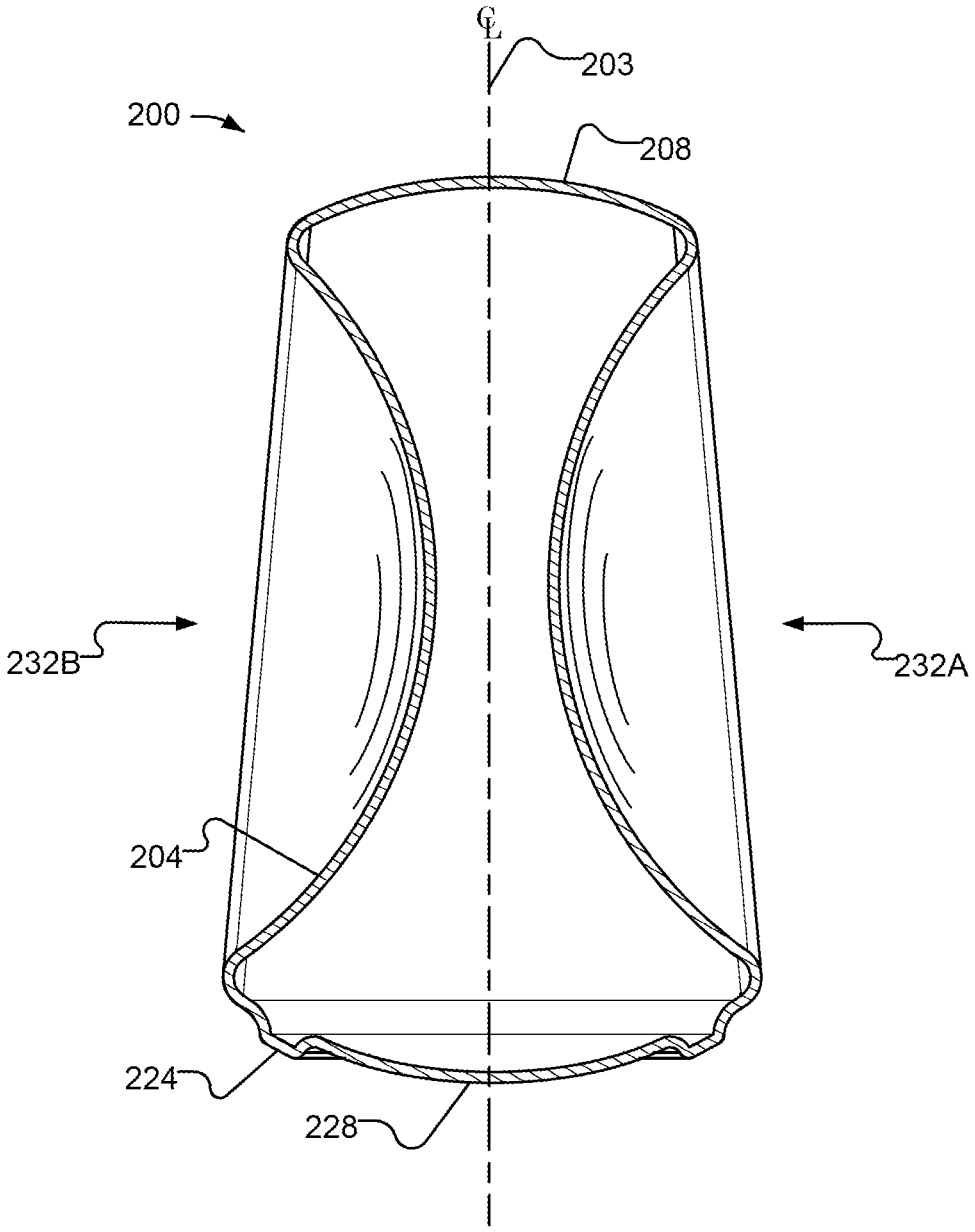
FIG. 10 is a cross section view of the chair of FIG. 9.

As can be seen in FIG. 10, first side portion 232A and second side portion 232B are preferably concave with respect to a vertical axis 202, bending inward between connections at a lower part with rounded lower portion 228 and at an upper part with seat portion 208. The concave profiles of first side portion 232A and second side portion 232B allow chair 200 to be hollow and shell 204 to be relatively thin while still supporting a sitter. Shell 204 may be made of any suitable material, such as acrylonitrile butadiene styrene, and for use as an active chair may have a thickness of from about 0.32 cm to 1.27 cm, and preferably about 0.64 cm.

Figure 11:
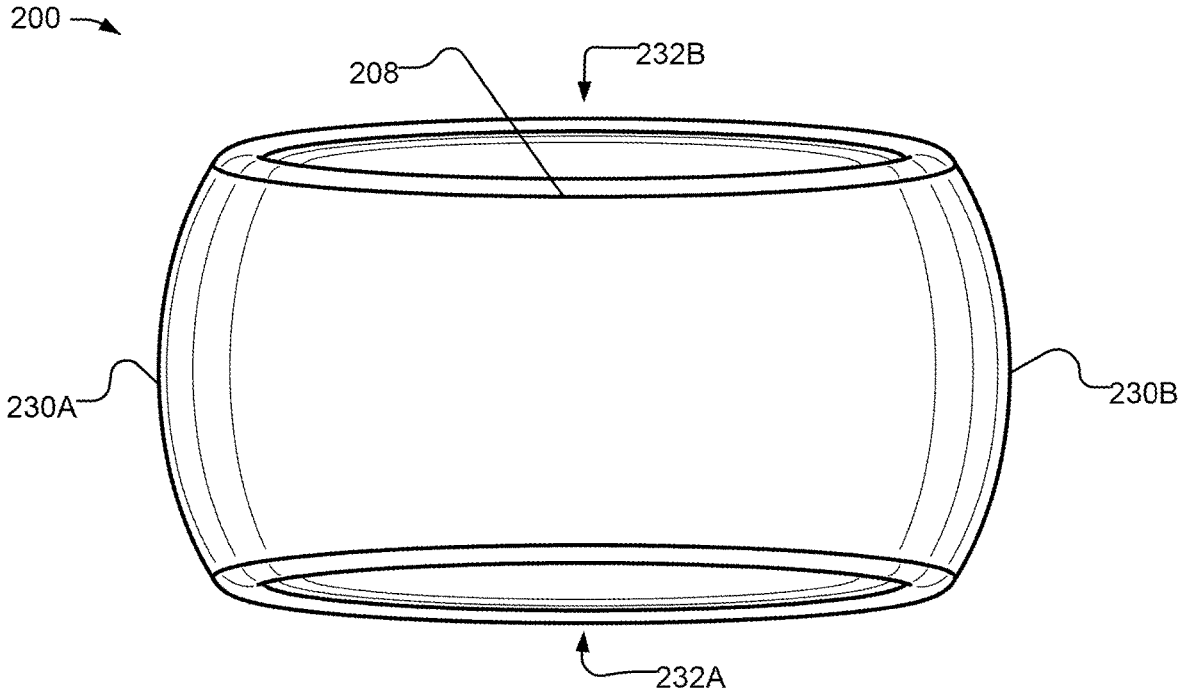
FIG. 11 is a top view of the chair of FIG. 7.

Chair 200 may preferably have a tapered profile from bottom to top, as can best be seen in FIGS. 8 and 11, in which when viewed from the front or back, the width of chair 200 is wider at the bottom than at the top.

The inward curving portions of the side members may be such that in a preferred embodiment a portion of each of the side members extends more than halfway to a vertical centerline 203 of the shell at least at the most extended portion as shown in FIG. 10.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. An active sitting chair comprising:

a bottom portion, a top portion, a front member, a back member, a first side member, and a second side member opposite the first side member, wherein the front member connects and curves outwardly between the bottom portion and the top portion, wherein the back member connects and curves outwardly between the bottom portion and the top portion, wherein the first side member is connected to the bottom portion and the top portion, is connected to the front member and the back member, and curves inwardly between the bottom portion and the top portion, wherein the second side member is connected to the bottom portion and the top portion, is connected to the front member and the back member, and curves inwardly between the bottom portion and the top portion, wherein the first side member forms a first inwardly curving, uninterrupted surface extending across an entire first side area defined by the bottom portion, the top portion, the front member, and the back member, and the second side member forms a second inwardly curving, uninterrupted surface extending across an entire second side area defined by the bottom portion, the top portion, the front member, and the back member, such that the first inwardly curving, uninterrupted surface, the second inwardly curving, uninterrupted surface, the top portion, the bottom portion, the front member, and the back member form a hollow monocoque shell without any open areas passing through any portion of the entire first side area to any portion of the entire second side area;

a seat area on the top portion; and a rounded lower portion attached to the bottom portion and arranged to rest on a supporting surface.

2. The active sitting chair of claim 1, wherein the rounded lower portion is shaped to induce tilting motion of the chair about a vertical axis when a user is on the seat and the rounded lower portion is on the supporting surface.

3. The active sitting chair of claim 2, further including a ring positioned above the rounded lower portion and configured to limit a range of the tilting motion.

4. The active sitting chair of claim 2, further including a first indentation on the front member and a second indentation on the back member, wherein the first indentation and the second indentation are shaped to accommodate a grasp of the user.

5. The active sitting chair of claim 2, wherein the shell is of unitary construction.

6. The active sitting chair of claim 5, wherein the shell is less than 1 cm thick.

7. The active sitting chair of claim 5, wherein the front member includes a front member bottom width and a front member top width, wherein the front member bottom width is wider than the front member top width, wherein the back member includes a back member bottom width and a back member top width, and wherein the back member bottom width is wider than the back member top width.

8. The active sitting chair of claim 5, wherein the first side member extends more than half way to a vertical centerline of the shell and wherein the second side member extends more than half way to the vertical centerline of the shell.

9. The active sitting chair of claim 5, wherein the shell does not include any holes passing from the first side member to the second side member.

10. An active sitting chair comprising:

a ring-shaped outer portion forming a continuous surface having a bottom portion, a top portion, a front portion, a rear portion, a first side edge, and a second side edge opposite the first side edge;

a first side portion connected to the first side edge, wherein the first side portion curves inwardly from the first side edge; and a second side portion connected to the second side edge, wherein the second side portion curves inwardly from the second side edge; and a rounded lower portion attached to the bottom portion and arranged to rest on a supporting surface, wherein the first side portion is attached continuously along the first side edge and forms a first inwardly curving uninterrupted surface extending across an entire first side area bounded by the bottom portion, the top portion, the front portion, and the rear portion and the second side portion is attached continuously along the second side edge and forms a second inwardly curving uninterrupted surface extending across an entire second side area bounded by the bottom portion, the top portion, the front portion, and the rear portion such that the first inwardly curving uninterrupted surface, the second inwardly curving uninterrupted surface, the top portion, the bottom portion, the front portion, and the rear portion form a hollow, uninterrupted monocoque shell with no open areas passing through any part of an area surrounded by the ring-shaped outer portion.

11. The active sitting chair of claim 10, wherein the ring-shaped outer portion has a width and wherein the width is narrower at the top portion than at the bottom portion.

12. The active sitting chair of claim 10, wherein the first inwardly curving uninterrupted surface extends more than half way to a vertical centerline of the ring-shaped outer surface and wherein the second inwardly curving uninterrupted surface extends more than half way to the vertical centerline of the ring-shaped outer surface.

13. The active sitting chair of claim 10, wherein the rounded lower portion is shaped to induce tilting motion of the shell about a vertical axis when a user is seated on the shell and the rounded lower portion is on the supporting surface.

14. The active sitting chair of claim 13, further including a ring positioned above the rounded lower portion and configured to limit a range of the tilting motion.

15. The active sitting chair of claim 14, further including a first indentation on the front portion and a second indentation on the rear portion, wherein the first indentation and the second indentation are shaped to accommodate a grasp of the user.

16. The active sitting chair of claim 14, wherein the shell is less than 1 cm thick at all points.

17. The active sitting chair of claim 14, wherein the shell does not include any holes larger than 1 cm in diameter.

18. The active sitting chair of claim 14, further including a seat on the top portion.

* * * * *